US006860083B2

(12) United States Patent
Torre

(10) Patent No.: US 6,860,083 B2
(45) Date of Patent: Mar. 1, 2005

(54) PROCESS, DEVICE AND SYSTEM FOR AUTOMATICALLY CONTINUOUSLY PACKAGING PRODUCTS

(75) Inventor: Francesco Torre, Dalmine (IT)

(73) Assignee: Minipack-Torre S.p.A., Dalmine (IT)

( * ) Notice: Subject to any disclaimer, the term of this patent is extended or adjusted under 35 U.S.C. 154(b) by 48 days.

(21) Appl. No.: 10/204,405

(22) PCT Filed: Feb. 15, 2001

(86) PCT No.: PCT/IT01/00070

§ 371 (c)(1),
(2), (4) Date: Aug. 27, 2002

(87) PCT Pub. No.: WO01/64515

PCT Pub. Date: Sep. 7, 2001

(65) Prior Publication Data

US 2003/0115839 A1 Jun. 26, 2003

(30) Foreign Application Priority Data

Mar. 2, 2000 (IT) ..... TO2000A0197

(51) Int. Cl.[7] ..... B65B 9/06
(52) U.S. Cl. ..... 53/55; 53/66; 53/550
(58) Field of Search ..... 53/450, 461, 463, 53/465, 55, 500, 66, 547, 548, 550

(56) References Cited

U.S. PATENT DOCUMENTS 3,055,154 A * 9/1962 Markley et al. ..... 53/551
3,229,442 A * 1/1966 Gram ..... 53/450
3,339,337 A * 9/1967 Rapp et al. ..... 53/562
4,219,988 A * 9/1980 Shanklin et al. ..... 53/550
4,483,126 A * 11/1984 Henry ..... 53/551
4,729,210 A * 3/1988 Galliano ..... 53/441
4,965,986 A * 10/1990 Klinkel ..... 53/551
5,247,746 A * 9/1993 Johnson et al. ..... 53/432
5,351,464 A * 10/1994 Francioni ..... 53/450
5,566,526 A * 10/1996 Suga ..... 53/75
5,689,942 A * 11/1997 Suga ..... 53/550

FOREIGN PATENT DOCUMENTS

FR 2 379 436 9/1978
GB 2 233 305 * 1/1991 ..... B65B/9/06

* cited by examiner

*Primary Examiner*—Eugene Kim
*Assistant Examiner*—Paul Durand
(74) *Attorney, Agent, or Firm*—Oblon, Spivak, McClelland, Maier & Neustadt, P.C.

(57) ABSTRACT

A device and system for automatically continuously packaging products through a heat-sealed plastic film. The device and system insert and supply the product downstream in a timed way and along a horizontal direction. A plastic film is applied to the products. The first end of each one of the products is heat-sealed, and each one of the products is simultaneously advanced horizontally. A second end of each one of the products is heat-sealed, and each one of the products is then simultaneously advanced horizontally. The heat-sealed products are then collected and unloaded. The device may be equipped with pairs of pliers for sealing and handling with a mutually opposite reciprocating movement.

16 Claims, 3 Drawing Sheets

PROCESS, DEVICE AND SYSTEM FOR AUTOMATICALLY CONTINUOUSLY PACKAGING PRODUCTS

BACKGROUND OF THE INVENTION

1. Field of the Invention

The present invention refers to a process, to a device and to the related system for automatically continuously packaging products, particularly graphic products, through heat-sealed plastic films.

2. Discussion of the Related Art

Hereinbelow the present invention will be described as applied to the packaging of graphic products such as magazines, printed matters, fascicles, newspapers, texts, books, etc. with different formats, but obviously it can be applied to any product adapted to be packaged in a heat-sealed plastic film.

Various devices are known in the art for dragging graphic products, that allow horizontally or vertically translating such products with respect to the ground. In particular, dragging and sealing pliers are known that are adapted to transversally seal heat-sealed plastic films. Such pliers are usually composed of lower striker pliers, on which a mat abuts that conveys the products around which the film to be heat-sealed has been wrapped; the lower pliers are adapted to cooperate with spring-actuated upper pliers equipped, on their lower face, with a hot wire that seals and cuts the film. When the two upper and lower pliers assume a closed working position, the upper pliers are pushed downwards and the hot wire with which they are equipped press onto the film and have as abutment the mat and the lower pliers, on which they abut for heat-sealing and cutting.

Systems for wrapping plastic films and for sealingly heat-sealing them are known for packaging graphic products. In particular, in the so-called longitudinal sealing, a hot roller is present that, by rotating on the length of overlapped film, activates its sealing in order to make a film that longitudinally wraps a product. The hot rotating roller works in cooperation with a fixed abutment blade that can be found below the films. The roller can be inserted immediately after the film bending device and can be connected thereto.

GB-A-2 233 305 discloses a method of wrapping various types of articles by means of a stretchable plastic film, and a machine for carrying out said procedure corresponding to the preambles of claims 1 and 3, respectively.

U.S Pat. No. 5,689,942 discloses a drive motor controlling apparatus for use in packaging machines.

FR-A-2 379 436 discloses a packaging machine for printed matter and its related process.

SUMMARY OF THE INVENTION

Object of the present invention is solving the above prior-art problems, by providing a process, a device and a system for automatically continuously packaging products, particularly graphic products, through heat-sealed plastic films; such arrangement can be applied to rigid or flexible products with different format and overall sizes, simply and immediately adjusting the whole system according to the product to be treated.

The above and other objects and advantages of the invention, as will appear from the following description, are obtained with a process and a system as set forth in the claims. Preferred embodiments and non-trivial variations of the present invention are also set forth in the claims.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF THE PREFERRED EMBODIMENTS

Figure 1:
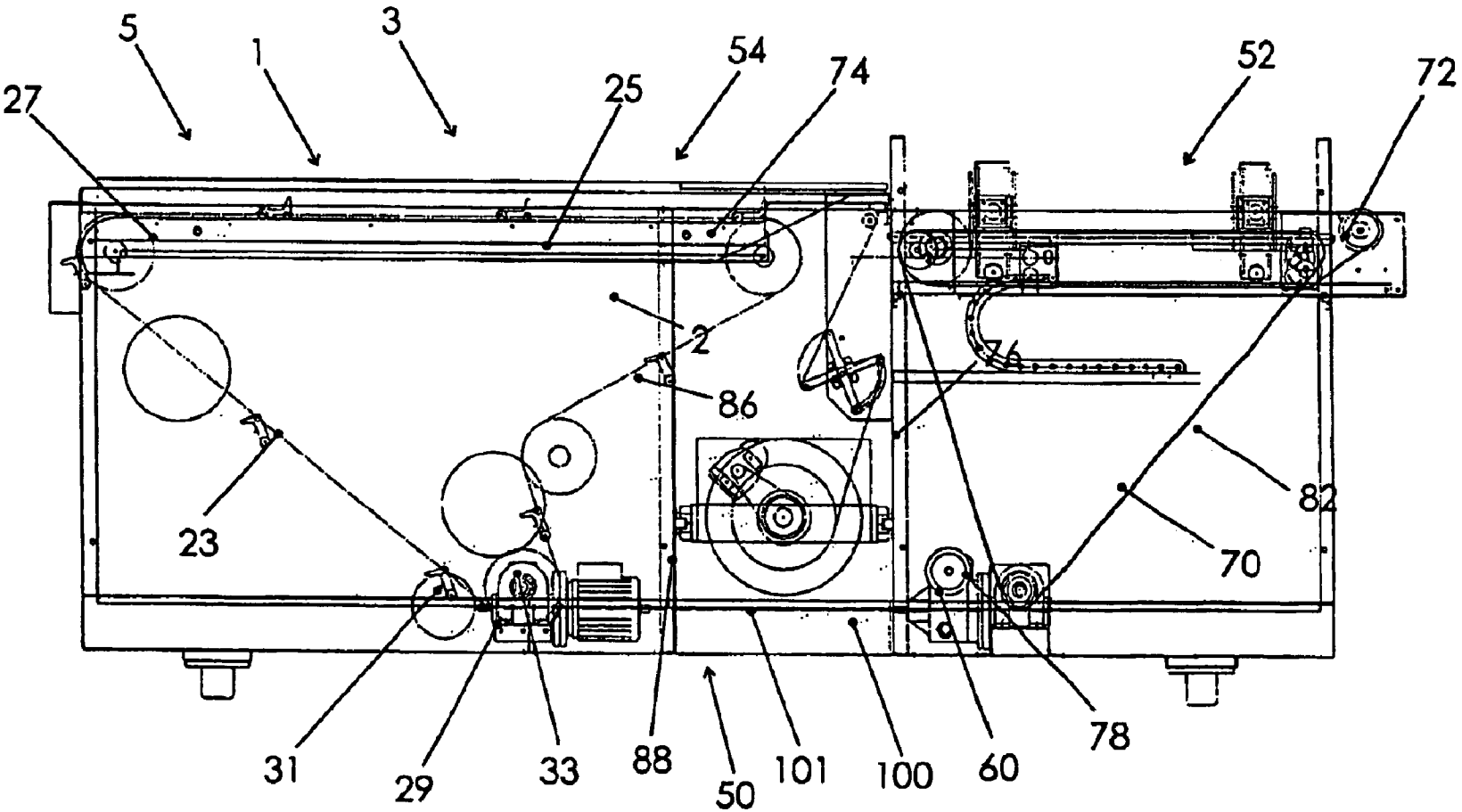
FIG. 1 is a side schematic view of an embodiment of the system and the device according to the present invention.
Figure 2:
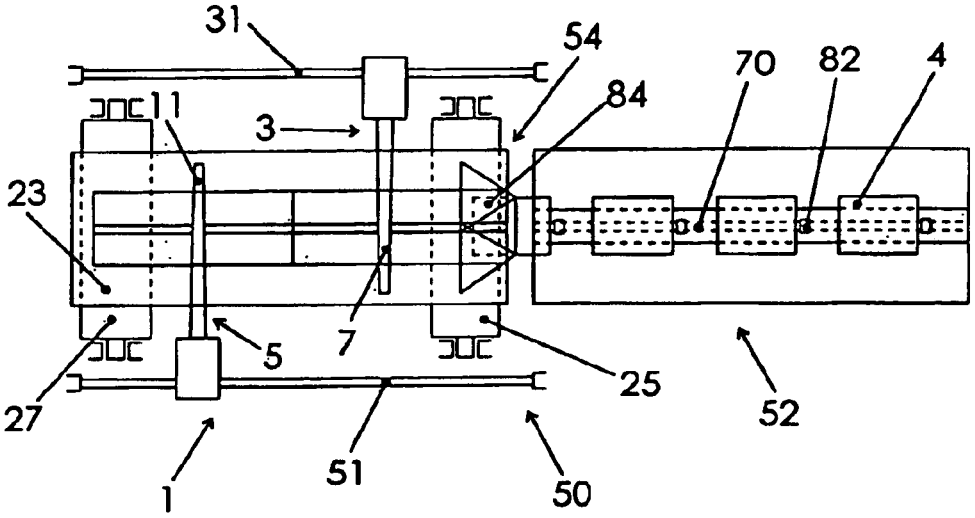
FIG. 2 is a partial schematic top view of the device and the system in FIG. 1.

With reference to the Figures, a preferred and non-limiting embodiment of the system and the device of the present invention is shown. First of all, the system as realized is composed of several mechanical, electric, electronic and pneumatic elements inserted into a suitably cartered carrier structure, in order to prevent possible accidents and lesions.

The device 1 for automatically continuously packaging products 4 through heat-sealed plastic films 2 of the present invention will be described first, and then its application will be described to a real system for supplying, packaging, advancing and unloading products.

The device 1 of the invention comprises at least a pair of pliers 3, 5 that mutually reciprocatingly move, in parallel with the advancement direction of the products 4. Such movement occurs along respective guides 3', 5' and is controlled along one direction by common transmission means, and along the opposite direction through the thrust force of a pneumatic piston 6.

Figure 4:
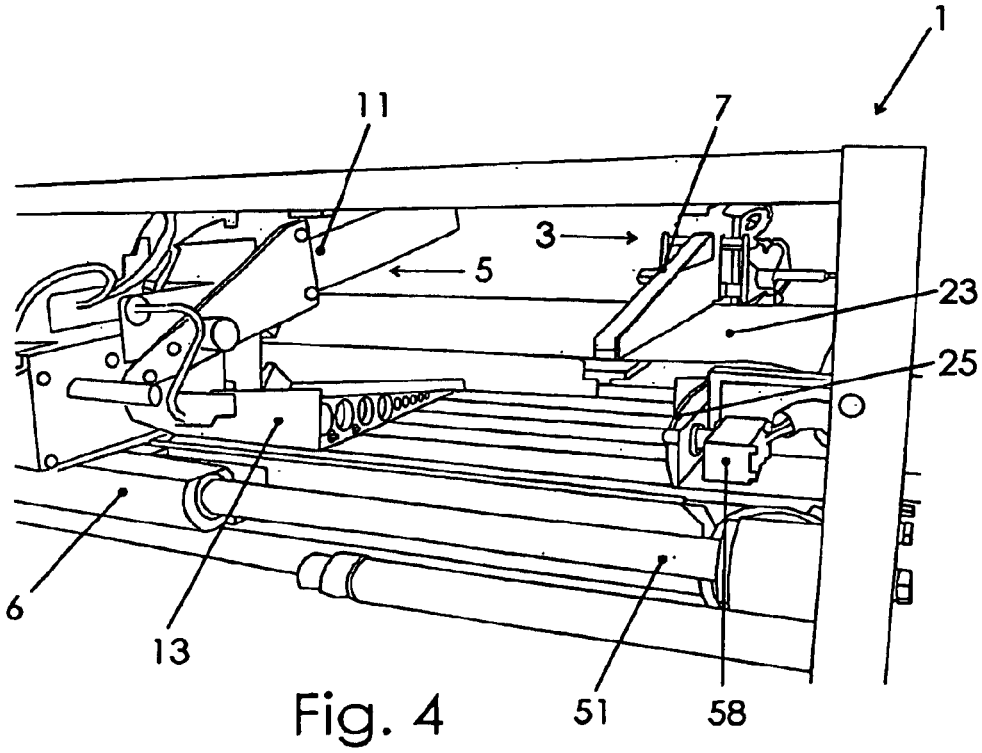
FIG. 4 is a perspective view of the device in FIG. 1.
Figure 3:
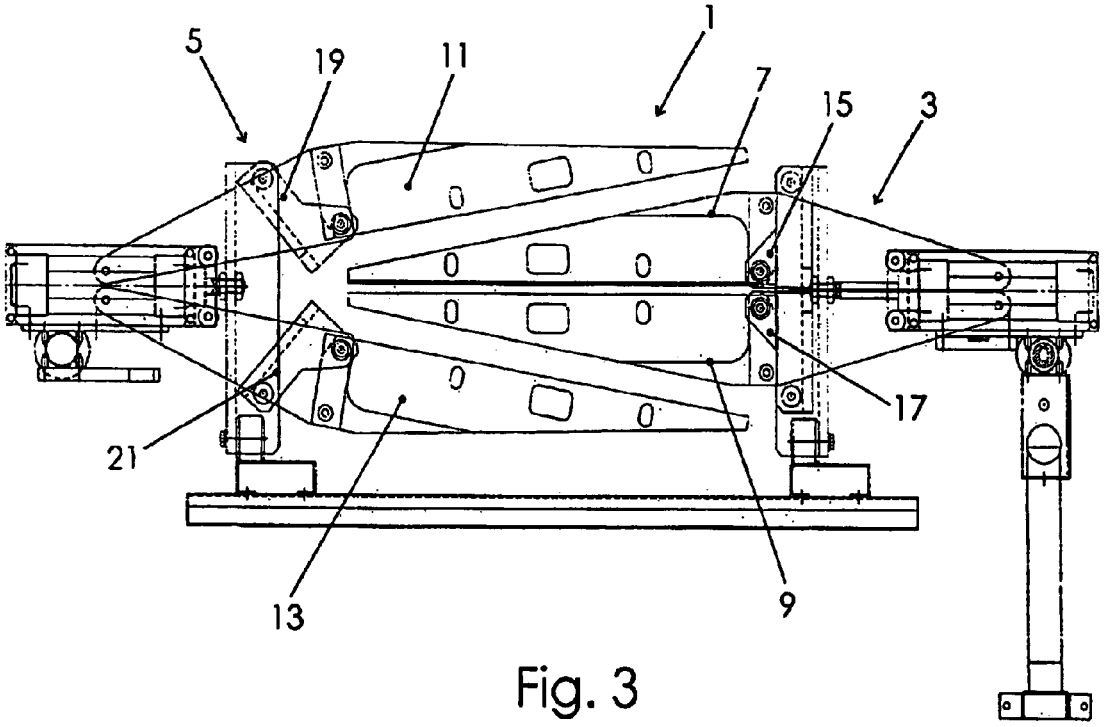
FIG. 3 is a side view of the device in FIG. 1.

Each one of the pliers 3, 5 is composed of at least two mutually integral arms 7, 9 and 11, 13, where each of the pairs of arms 7, 9 and 11, 13 of each pliers 3, 5 is adapted to assume an opening position and a closing position in which the film 2 is heat-sealed and cut onto the products 4 and the products 4 themselves are dragged. Moreover, each one of the pliers 3, 5 is shaped so that, when it is in its closing position, is adapted to penetrate (as better shown in FIG. 3) into a clearance obtained inside the opening between the arms of the other one of the pliers 5, 3 that is in its opening position. This arrangement is realised by shaping the arms 7, 9 and 11, 13 of each one of the pliers 3, 5 as a chute (according to the side view in FIG. 3). Due to this shaping, the pliers 3, 5 are able to mutually exchange their position, alternatively opposed one to the other, by passing one inside the other in order to move to the two operating positions. For example, with reference to FIG. 4, when the pliers 3 are in a tightened position and are moving the product 4, the pliers 5 are in their opened position and are moving in an opposite direction with respect to the direction of the pliers 3 and the product 4 being moving, in order to go to the position in which the pliers 3 were previously located. Their shaping allows, when they are crossing one another, to make the closed pliers 3 pass inside the opened pliers 5, without generating mutual destructive interferences.

The Figures show a preferred practical embodiment of the pliers 3, 5 of the device 1 of the invention; in them, each arm 7, 9 and 11, 13 of each pair of pliers 3, 5 is equipped with at least one linkage 15, 17 and 19, 21 that is shaped and realised so that the arm itself exerts when closing an enough force to perform the heat-sealing and cutting of the plastic films 2, and the dragging of products 4 when they are advancing.

The dragging of products 4 when they are advancing is performed through at least one continuous belt 23 moving around at least one pair of idle rollers 25, 27 and handled by the pliers 3, 5 connected to handling means 29, 31, 33. The belt 23 is preferably made of silicone rubber (or another heat-sealing sensitive device), in order to guarantee on one hand to better grasp the products 4 that are placed thereon and dragged for advancing them, and on the other hand a better grasping surface as regards the pliers 3, 5 that must grasp and drag the belt itself. The belt is preferably formed of bands, in order to facilitate its insertion on the end roller 27, where the products 4 come out, since the end roller 27 is composed of disks (not shown) made of sheet and interposed between the different bands and that project from the band 23 for a certain height that is compatible with the required use. Purpose of such disk projection from the bands of the conveyor belt 23 is lifting or detaching the product 4 from the belt 23 if, during the previous sealing, the plastic film had remained attached to the belt 23 itself.

In particular, the handling means 29, 31 of the device are composed of a motored speed variator 29 with related speed reducer 31 and of a regulator 33, that can be of the automatic or manual type, to allow, as will be better described below, adjusting the speed of the belt 23 according to the type of product 4 to be packaged and handled.

The above-described device 1 of the invention can be optimally used in a complete system 50 for automatically continuously packaging products 4 through heat-sealed plastic films 2, such system 50 being also part of the present invention. Such system 50 first comprises, following a succession arranged along the advancement direction of the products 4, inserting means for the products 4 into the system. Such inserting means are not shown since they are known, and they can be automatic feeders or can exploit the manual supply of an operator.

The system 50 further comprises means 52 for the timed supply of the products 4, that are composed of chain-like means 70 supplied by a main motor 100 and wound as a ring around a plurality of rollers 72, 74, 76, 78; on the chain-like means 70 a plurality of pushing pawls 82 are arranged and are adapted to assume a straight operating position for pushing the products 4 and a bent rest position.

The system 50 then comprises means 54 for applying the plastic film 2 to the products 4, that are composed of bending means 84 for the film 2, unwinding means 86 for the film 2 and a bobbin 88 around which the film 2 is wound. The film 2 taken from the bobbin 88 is unwound by the means 84 and is made pass into the bending means 84, inside which the product 4 is placed being pushed by the timed supply means 52. Since the means 54 are placed immediately downstream of the timed supply means 52 and immediately upstream of the belt 23, when the product 4 has left the means 52 it has already been engaged by the belt 23 and goes on being fed forwards, usually with a speed of the belt 23 that is lower than the speed of the upstream means 52.

Immediately after the means 54 for applying the plastic film 2, then, at least one device 1 of the invention, as described above, is placed that performs the heat-sealing operation of the film 2 around the product 4 and its related cutting.

Finally, the system 50, downstream of the device 1, provides means for unloading and/or collecting the products 4 packaged with the now heat-sealed plastic films 2. Also these means for unloading and/or collecting are not shown since they are known, and can be of the manual or automatic type, such as for example an automatic stacking line or a line for the further downstream transport of the packaged products 4.

In order to effectively operate with products 4 of any size, the system 50 is further equipped with means for performing the operating timing between the products 4 and the pliers 3, 5 of the device 1 and with means for adjusting the working useful length of the device 1 itself.

The means for performing the operating timing are composed of a pulse counter 58 operatively connected to sensor means 60 in order to receive a count starting pulse; the pulse counter 58 sends, at the end of a certain count, a closure command to the one of the pliers 3, 5 that is in the operating position to perform heat-sealing and cutting.

Instead, the means for adjusting the working useful length of the device 1 are adapted to operate by exploiting the speed difference between the continuous belt 23 and the means 52 for the timed supply of the products 4. This is manually or automatically made through the regulator 33, that allows (according to the overall sizes of the products 4) changing the movement speed of the pliers 3, 5 through its connection to the motor speed variator 29 with related speed reducer 31.

As can be seen in the Figures, finally, for a better global economy and functionality, the system 50 is wholly handled by a single main motor 100 that directly supplies the means 52 for the timed supply of the products 4 and, through a shaft 101 equipped with electromagnetic pulleys, also the device 1.

The operation of the device 1 according to the present invention will now be described.

The graphic product 4 is first manually placed on an horizontal feeder, or through an automatic feeder. In such a way, with the continuous forward translation movement, the feeder allows the continuous insertion into the system of the graphic product 4 through the thrust pawls 82 hinged to the chain 70. The pawl 82 disengages the product 4 when this one has already been "grasped" and moved, taking it forwards, by the means 54.

After the means 54 have placed, in a known way, the plastic film 2 around the product 4, this latter one is dragged, transversally sealed and cut at its two ends in order to complete its packaging. Such operations are performed by the pliers 3, 5 of the device 1, with the pliers 3, 5 that alternately translate on the guides 3', 5', wherein the translation along the advancement direction of the product 4 is performed by suitable electromagnetic inserts (not shown) placed on the transmission shaft, while the backward translation occurs through the pneumatic pistons 6. The pliers 3, 5 are controlled through common control means, for example of the PLC type. After having heat-sealed and cut the first end of the product 4, the affected pliers make also advance both the product 4 and the belt 23 on which it rests and that idly rotates on the rollers 25, 27. Simultaneously, when the affected pliers begin advancing, through a microswitch (not shown) placed on the pliers themselves, an electric command is transmitted that disconnects the belt transmission to the other pliers, that are pushed by the piston 6 into their starting working position, where they remain waiting for the following product 4: when this latter one comes in position, the second pliers heat-seal and cut the film 2 in a position that is at the same time the second end of the product 4 that has passed immediately beforehand and the first end of the following product 4 that came in that position.

In a known way, the speed adjustment for the means 52 occurs through a potentiometer (not shown) that, through an inverter (frequency converter), operates on the main motor 100. The belt 23 instead, though taking the motion derived from the main motor 100, as already stated, can change its movement through the regulator 33 that operates on the speed variator 29.

Summarising, the device 1 and the system 50 allow realising a process for automatically continuously packaging products 4 through heat-sealed plastic films 2 comprising the steps of:

inserting the products 4;

supplying the products 4 downstream in a timed way and along an horizontal direction;

applying the plastic film 2 to the products 4;

heat-sealing and cutting a first end of each one of the products 4;

simultaneously with the step of heat-sealing and cutting a first end, advancing each one of the products 4 horizontally;

heat-sealing and cutting a second end of each one of the products 4;

simultaneously with the step of heat-sealing and cutting a second end, advancing each one of the products 4 horizontally; and collecting and unloading each one of the heat-sealed products 4.

Moreover, the process that can be realised with the above-described system 50 and device 1 comprises the step of operatively timing the steps of timed supplying and heat-sealing and cutting of a first end of each one of the products 4. Such step of operatively timing comprises the steps of:

detecting a movement speed of the timed supplying step;

activating the counting means 58 according to the detected speed of the timed supplying step; and performing the step of heat-sealing and cutting the first end after the counting means 58 have reached a certain count depending on the overall sizes of the products 4.

Finally, the inventive process also comprises the step of adjusting a working length for sealing and advancing the products 4 according to their overall sizes, that is performed by exploiting the difference between a speed of the timed supplying step and an advancement speed of the products 4 when heat-sealing.

In this way, a continuous and automatic cycle is obtained for packaging products into transparent heat-sealable plastic films, with the simultaneous translation of the products between the loading and unloading positions of the system, and the following working sites downstream of the system itself.

Some preferred embodiment of the present invention have been shown and described above: obviously, numerous variations and modifications, that are functionally equivalent to the previous ones, will immediately appear evident for the skilled people in the art, such variations and modifications falling within the scope of the invention as claimed in the enclosed claims.

What is claimed is:

1. System for automatically continuously packaging, comprising:

means for inserting a product;

means for timed supply of the product;

means for applying a plastic film to the product;

a pair of pliers, each of the pliers configured to reciprocatingly move parallel to an advancing direction of the product, each of the pliers comprising a pair of arms configured to close to cut and to seal the product in the plastic film and configured to open to permit passage therebetween of the arms of the other pliers;

means for performing operatively timing between the product and the pliers;

means for adjusting a working useful length of said device;

means for at least one of unloading and collecting the product sealed in the film; and a continuous belt configured to receive the product sealed in the film, the continuous belt configured to be gripped and advanced by the closed arms of the pliers;

wherein said means for performing operatively timing comprises a pulse counter configured to be operatively connected to a sensor to receive a count starting pulse, said pulse counter configured to send a command to close one of said pliers and wherein said means for adjusting the working useful length of said device comprises a regulator configured to be connected to a motor speed variator and a speed reducer.

2. System according to claim 1, wherein the arms comprise sloped surfaces.

3. System according to claim 1, wherein the pliers are configured to be disposed opposite one another.

4. System according to claim 1, wherein the pliers are configured to move along guides and are configured to be displaced by a pneumatic piston.

5. System according to claim 1, wherein one of the pliers comprises a linkage configured to close the arm, to seal and to cut the film, and to drag the product in the advancing direction.

6. System for automatically continuously packaging products through heat-sealed plastic films, comprising:

inserting means for the product;

means for timed supply of the products;

means for applying a plastic film to the products;

at least one device comprising at least a pair of pliers configured to reciprocatingly move in parallel with an advancement direction of the products, each pliers comprising a pair of mutually integral arms, said pairs of arms of each pliers being configured to assume an opening position and a closing position in which the plastic film is heat-sealed and cut onto the products and the products are dragged, each one of said pliers being shaped, when in their closing position, to pass through a clearance between the pair of arms of the other of said pliers in the opening position;

means for performing operatively timing between the products and the pliers;

means for adjusting a working useful length of said device; and means for at least one of unloading and collecting the products packaged with heat-sealed plastic film;

wherein said means for performing operatively timing comprises a pulse counter operatively connected to a sensor and configured to receive a count starting pulse, said pulse counter configured to send at an end of a certain count a closure command to one of said pliers in the closing position to perform heat-sealing and cutting; and wherein said means for adjusting the working useful length of said device comprises a regulator connected to a motor speed variator with a speed reducer, wherein each arm of each pair of pliers is equipped with at least one linkage configured to make the each arm exert, when closing, enough force to perform the heat-sealing and cutting of plastic films and the dragging of products when advancing in the advancement direction, and wherein the dragging of products when advancing is performed through at least one continuous belt moving around at least one pair of idle rollers and handled by said pliers connected to handling means, said continuous belt having placed thereon the products and configured to be grasped by said pliers and dragged together with said pliers along an advancement direction of the products.

7. System according to claim 6, wherein said handling means comprises the motor speed variator, the speed reducer, and the-regulator.

8. System according to claim 7, wherein said continuous belt comprises at least one of silicone rubber and a heat-resistant material.

9. System according to claim 1, wherein said regulator is configured to be manually operated based on an overall size of the product.

10. System according to claim 1, further comprising:

a motor configured to operate said means for timed supply of the product.

11. System according to claim 1, wherein said means for timed supply of the product comprises chain-like means configured to be operated by said motor and surrounding a plurality of rollers and a plurality of pushing pawls configured to push the product.

12. System according to claim 1, wherein said means for applying the plastic film to the products comprises means for bending the film, means for unwinding the film, and a bobbin.

13. System according to claim 1, wherein said means for inserting the product is configured to receive the product manually.

14. System according to claim 1, wherein said means for inserting the product is configured to receive the product automatically.

15. System according to claim 1, wherein said means for at least one of unloading and collecting is configured to deliver the product manually.

16. System according to claim 1, wherein said means for at least one of unloading and collecting is configured to deliver the product automatically.

* * * * *